US006668155B1

(12) United States Patent
Hubble, III et al.

(10) Patent No.: US 6,668,155 B1
(45) Date of Patent: Dec. 23, 2003

(54) LEAD EDGE PAPER CURL SENSOR

(75) Inventors: Fred F. Hubble, III, Rochester, NY (US); Tonya L. Love, Rochester, NY (US); Daniel A. Robbins, Williamson, NY (US); Stanley J. Wallace, Victor, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/202,209

(22) Filed: Jul. 23, 2002

(51) Int. Cl.[7] ..... G03G 15/00; G03G 21/00

(52) U.S. Cl. ..... 399/406; 399/390; 162/197; 162/270; 250/559.01; 356/445

(58) Field of Search ..... 399/406, 341, 399/45, 390; 356/371, 372, 373, 445, 448, 498; 250/559.01; 162/197, 198, 270, 271; 271/161, 188, 209

(56) References Cited

U.S. PATENT DOCUMENTS

| | | | | |
|---|---|---|---|---|
| 5,138,178 A | | 8/1992 | Wong et al. | 250/559.28 |
| 5,144,385 A | * | 9/1992 | Tani | 399/406 |
| 5,539,511 A | | 7/1996 | Wenthe, Jr. et al. | 399/361 |
| 5,787,331 A | * | 7/1998 | Ohkuma et al. | 399/406 |
| 5,847,405 A | | 12/1998 | Acquaviva et al. | 250/559.36 |
| 5,859,440 A | | 1/1999 | Acquaviva | 250/559.36 |
| 6,094,560 A | | 7/2000 | Thomas | 399/341 |
| 6,351,308 B1 | | 2/2002 | Mestha | 356/402 |
| 6,384,918 B1 | | 5/2002 | Hubble, III et al. | 356/402 |

FOREIGN PATENT DOCUMENTS

| | | | |
|---|---|---|---|
| JP | 08-198477 | * | 8/1996 |
| JP | 09-006073 | * | 1/1997 |
| JP | 10-077152 | * | 3/1998 |
| JP | 10-123781 | * | 5/1998 |

* cited by examiner

*Primary Examiner*—Sophia S. Chen

(57) ABSTRACT

A sheet curl measurement system and method and an automatic sheet decurling system controlled thereby for the printed paper sheets output of printer. The sheet curl may be remotely sensed without contacting or interfering with the motion of the sheets in their normal sheet path, using a simple but accurate optical sheet curl sensor operating on a portion of the moving sheet at an angle thereto and perpendicularly thereto, with displacement insensitive optics, in both an angular direction substantially parallel to the sheet movement direction and an angular direction substantially transverse to the sheet movement direction, with ratioing of the two output signals.

12 Claims, 3 Drawing Sheets

LEAD EDGE PAPER CURL SENSOR

Disclosed is a relatively low cost, simple, and non-contacting system for detecting or measuring either or both lead edge and trail edge curl of sheets, especially, print media sheets moving in a conventional paper transport path, which is easily mounted to conventional such sheet transport paths, and is fast enough in operation to provide "real time" measurement data which may be used to provide "on line" automatic control of various automatic sheet decurling systems.

Disclosed in the embodiment herein is an improved system for measuring the amount of curl of an edge of a print media sheet moving through a printer or other media handling system. The disclosed system provides a novel optical reflectivity sensing system for providing an electrical output signal responsive to the curl of the paper or other sheet passing a relatively simple optical sensor in a sheet transport path with relatively uncritical confinement of the sheet being measured.

The disclosed sheet curl sensing system embodiment is thus particularly suitable for the implementation of a "closed loop" curl detection plus curl correction system, by providing a more accurate curl detection signal in a high speed, on line manner, and without needing to contact the paper. Furthermore, this may be accomplished even though there is ink, toner, or other imaging material on the curled edge of the sheet, or with different color sheets. Further disclosed in the embodiment herein are displacement insensitive optics for this measurement, to render less critical the position of the sheet relative to the sensor, and thus allow more accurate sheet curl measurements to be made in various different normal, relatively unconfined, sheet transport paths.

In addition to the optional use of the curl detection signal of the disclosed sheet curl detector to control an automatic, (e.g., variable penetration roller depth) mechanical sheet decurler, the curl detection signal may also be optionally used additionally or separately to control an automatic remoisturizer in the same paper path, such as between the fuser and the output tray, to remoisturize the sheet and thereby automatically additionally or alternatively reduce detected sheet curl.

The curling of print media sheets is a particular problem in the printing industry. It is exacerbated by high-density images and plural color printing. However, sheet curling can occur even for unprinted sheets of paper with changes in the ambient humidity or moisture content of the paper. Sheet curl can interfere with proper sheet feeding, causing sheet feeding jams or delays. If sheet curl is present in the output it can interfere with proper stacking or other finishing operations of the sheets. For example, if printed sheets with curl do not lie flat when stacked together in sets, such as in the pages of booklets, an objectionable distortion of the booklet may result.

Furthermore, the amount of moisture in the sheet of paper can drastically change from the printing process itself, to cause or exacerbate curl. In particular, from water-based ink jet printing or the thermal fusing operation for toners in xerographic printing, and particular from high density image printing near the edges of a sheet. There is a further sheet curl problem in duplex printing, where the sheets are re-fed or recirculated for printing imaging material on their second sides, especially if that involves a second pass of the sheet through a thermal fuser and/or higher density images on one side than the other.

It is known to use decurlers with adjustable amounts of sheet decurling in the output of printers to at least partially correct or compensate for sheet curl. Some examples of automatic or manually adjusted sheet decurling systems include Xerox Corporation U.S. Pat. Nos.: 5,392,106; 5,515,152; 5,519,481; 5,539,511; 5,565,971; 5,848,347; 6,003,864; and 6,314,268. Note that while, for example, said U.S. Pat. No. 5,539,511 does not explicitly identify a control signal, it describes variable position decurling rollers with a position controlled by solenoid, screw drive, etc., according to the amount of expected sheet curl.

Sheet remoisturizing systems are another alternative or additional known means for reducing sheet curl. Some examples of Xerox Corporation Patents on sheet remoisturizing or wetting systems include U.S. Pat. Nos.: 5,264,899; 5,850,589; 5,920,751; and 6,094,560 (the later also including decurling).

It would be particularly desirable to provide a more automatic, rather than manual, control of the appropriate amount of decurling force or deformation and/or remoisturizing of individual sheets as they are being outputted, for better sheet flattening before the sheet output, for improved stacking and/or finishing. The disclosed embodiment, as illustrated, can provide an electrical output control signal proportional to the amount of detected curl of individual sheets upstream of an automatic sheet decurler and/or remoisturizer to provide such a control thereof.

However, the disclosed exemplary sheet curl detection system is not limited to that particular application. Other applications will be apparent to those skilled in the printing or other sheet handling arts. For example, a system of automatically diverting (with a sheet path gate to a "purge" tray output) a sheet detected as having an amount of curl above a safe sheet feeding level, in order to avoid Is potential sheet jams in downstream sheet transport paths, imaging stations or finishing operations.

Of particular interest as to the disclosed sheet displacement insensitive optics of the embodiment herein is Xerox Corporation U.S. Pat. No. 6,384,918 B1 issued May 7, 2002 to Fred F. Hubble, III, et al., and the related disclosure in Xerox Corporation U.S. Pat. No. 6,351,308 B1 issued Feb. 26, 2002 to L. K. Mestha, and pending Xerox Corporation U.S. application Ser. No. 09/862,945, filed May 22, 2001 by the same Fred F. Hubble, III, et al.

The present system should be distinguished from previous systems for detecting the position of the edge of a document with optical detectors and angled illumination to form edge shadows, such as Xerox Corporation U.S. Pat. Nos. 5,847,405 and 5,859,440. Likewise, the present system should be distinguished from photoelectric transmissive paper basis weight thickness or density measurement devices, such as Xerox Corporation U.S. Pat. No. 5,138,178.

A specific feature of the specific embodiment disclosed herein is to provide a sheet curl sensing system for sensing the curl of a sheet moving in a movement direction in a sheet transport path, comprising an unobstructing non-contacting optical sheet curl sensor having a first sheet illuminator mounted to illuminate a portion of the moving sheet at an angle in a direction substantially parallel to said movement direction, a second sheet illuminator mounted to illuminate a portion of the moving sheet at an angle in a direction substantially transverse to said movement direction, and a photodetector system positioned to sense said illumination of the moving sheet by both said first and second sheet illuminators as said illumination is reflected approximately perpendicularly from said illuminated portion of the moving sheet and to provide variable output control signals in response to said sensed reflected illumination level.

Further specific features disclosed in the embodiment herein, individually or in combination, include those wherein said variable output control signals in response to said sensed reflected illumination are a ratio of the output control signals from said photodetector system produced by said first and second sheet illuminators; and/or an automatic sheet decurling system comprising a variable sheet decurler and/or re-moisturizer controlled by output control signals from an unobstructing non-contacting optical sheet curl sensor sensing the curl of a sheet moving in a movement direction in a sheet transport path towards said decurler and/or re-moisturizer, said optical sheet curl sensor comprising an unobstructing non-contacting optical sheet curl sensor having a first sheet illuminator mounted to illuminate a portion of the moving sheet at an angle in a direction substantially parallel to said movement direction, a second sheet illuminator mounted to illuminate a portion of the moving sheet at an angle in a direction substantially transverse to said movement direction, and a photodetector system positioned to sense said illumination of the moving sheet by both said first and second sheet illuminators as said illumination is reflected approximately perpendicularly from said illuminated portion of the moving sheet and to provide said output control signals in response to said sensed reflected illumination; and/or wherein said variable output control signals in response to said sensed reflected illumination are a ratio of the output control signals produced by said photodetector system from said first and second sheet illuminators; and/or a method of sensing the curl of a sheet moving in a movement direction in a sheet transport path, comprising optically remotely sensing the curl without contacting the sheet with optical sheet curl sensor having a first sheet illuminator illuminating a portion of the moving sheet at an angle in a direction substantially parallel to said movement direction and a second sheet illuminator illuminating substantially the same portion of the moving sheet at an angle in a direction substantially transverse to said movement direction, and a photodetector sensing said illumination of the moving sheet by both said first and second sheet illuminators as said illumination is reflected approximately perpendicularly from said illuminated portion of the moving sheet and providing variable output control signals in response to said sensed reflected illumination level; and/or wherein said variable output control signals are a function of the ratio of the output control signals produced by said photodetector from said first and second sheet illuminators; and/or an automatic sheet decurling system for the printed paper sheets output of printer having a paper path for said printed sheets, comprising a sheet curl measurement system providing an output signal for controlling said sheet decurling system, said sheet curl measurement system optically remotely sensing the curl of a sheet moving in said sheet path of said printer without contacting said sheet with an optical sensing system operating on a portion of the moving sheet at both an angle thereto and perpendicularly thereto, in both an angular direction substantially parallel to the sheet movement direction and an angular direction substantially transverse to the sheet movement direction, to provide at least two output signals which are ratioed to provide said output signal for said controlling of said sheet decurling system; and/or wherein said sheet curl measurement system has sheet displacement insensitive optics; and/or a method of automatic sheet decurling of the printed paper sheets of a printer with a sheet decurling system and sheet curl measurement system providing an output control signal for controlling said sheet decurling system, comprising remotely optically sensing the curl of a sheet moving in a sheet path of said printer with said sheet curl measurement system without contacting said sheet by optically operating on a portion of the moving sheet at both an angle thereto and perpendicularly thereto, in both a first angular direction substantially parallel to the sheet movement direction and a second angular direction substantially transverse to the sheet movement direction, to provide separate output signals from said first and second angular directions which are ratioed to provide said output signal for said controlling of said sheet decurling system; and/or wherein said remotely optical sensing includes the use of sheet displacement insensitive optics; and/or wherein said remotely optical sensing includes a first sheet illuminator sequentially illuminating a portion of the moving sheet at an angle in a direction substantially parallel to said movement direction and a second sheet illuminator alternatively illuminating substantially the same portion of the moving sheet at an angle in a direction substantially transverse to said movement direction, and a photodetector sensing said sequential illumination of the moving sheet by said first and second sheet illuminators as said illumination is reflected approximately perpendicularly from said illuminated portion of the moving sheet; and/or wherein said remotely optical sensing includes the use of sheet displacement insensitive optics.

The disclosed system may be operated and controlled by appropriate operation of conventional control systems. It is well-known and preferable to program and execute, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed and cut. A "copy sheet" may be abbreviated as a "copy" or called a "hardcopy." A "print job" is normally a set of related sheets, usually one or more collated copy sets copied from a set of original document sheets or electronic document page images, from a particular user, or otherwise related. A "simplex" document or copy sheet is one having its image and any page number on only one side or face of the sheet, whereas a "duplex" document or copy sheet normally has images printed on both sides.

As to specific components of the subject apparatus or methods, or alternatives therefor, it will be appreciated that, as is normally the case, some such components are known per se in other apparatus or applications, which may be is additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example below, and the claims. Thus, the present invention will be better understood from this description of this specific embodiment, including the drawing Figures (which may be approximately to scale unless indicated to be schematic) wherein:

FIG. 1 is a top view of an exemplary paper edge curl sensor, per se;

FIG. 2 is a cross-sectional side view of the sheet curl sensor of FIG. 1 as shown mounted in an operating position relative to a portion of a conventional sheet path of a conventional xerographic printer, downstream of a conventional fuser and upstream of (and controlling) known sheet decurling and sheet remoisturing systems (all as in examples cited above, and therefor illustrated here schematically);

Describing now in further detail this exemplary embodiment with reference to the Figs., the print media or other sheet of interest may be irradiated with light at an angle of approximately 45° and the reflectivity of that illumination is measured at approximately 0° with at least two channels.

In this embodiment, a first channel measures the reflectivity from the sheet perpendicular to the direction of motion of the print media, and another (second) channel measures the reflectivity from the sheet parallel to the direction of motion of the print media. The reflectivity measured by this second channel is more sensitive to the attitude of the paper, that is, the amount of lead edge curl of the paper. By taking the ratio of the second channel reading to that of the first channel reading, a measure of the lead edge curl may be made and provided as an output signal. Utilizing the ratio of these two signals desensitizes the measurement from the reflectivity of the sheet, since the sheet will have different reflectivity depending on the color of the sheet and whether there is imaging material (toner or ink) on the area of the sheet being illuminated at that point. The output of both measurement channels will be affected equally and the ratio will therefor not change.

Furthermore, by utilizing displacement insensitive optics, as shown and described, the measurement is also desensitized to the displacement of the sheet. In particular, the normal variations in the position of a sheet in the movement of the sheet along the sheet path between the normal spaced apart sheet path defining baffles. This allows non-critical spacing of the exemplary sensor from the measured sheet and the mounting of the sensor outside the sheet path.

Figure 1:
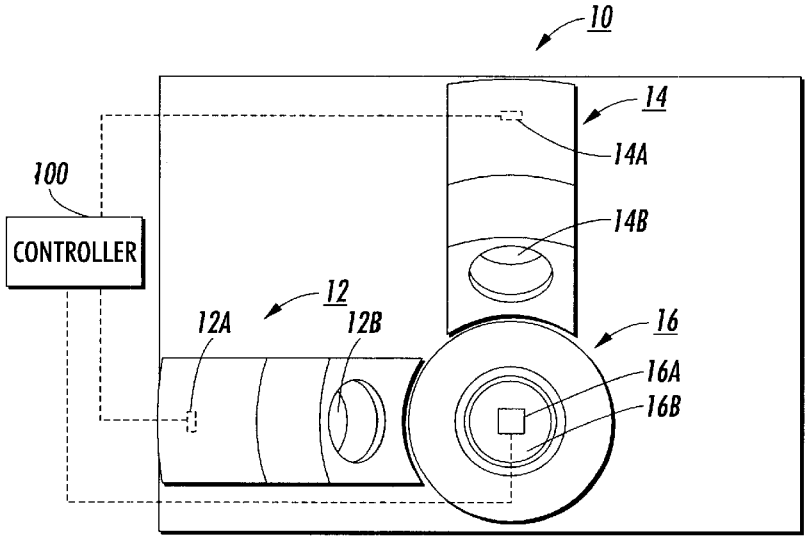

Referring to the drawings, in FIG. 2 the document edge curl detector system of FIG. 1 is shown positioned below (but could also be above) a sheet of paper traveling through a sensing area. The sensing area may be provided, as here, from outside the sheet path though a small aperture in one of the conventional sheet baffles. This sensing area here is defined by two separate light beams sequentially orthogonally illuminating the sheet, including any curled edge area of the sheet, as the sheet is conventionally transported in the conventional sheet path past the small sensing area.

The illumination does not need to be provided for the passage of the entire sheet. Continuous information as to the lead edge and trail edge position of a sheet in a printer sheet path is normally available from the printer controller. Thus, the illumination can be turned on, and sensing provided, only for the sheet lead edge and trail edge areas. Or, the sensor output signals blocked or ignored for any desired non-measurement time periods.

That is, measurement of the curl, if done a known distance from the lead and/or trail edge, could improve the quality of the curl information and thus allow better control of the decurler. For example measurement of paper curl may be more accurate if it is timed by the printer controller 100 to the known sheet position when the lead edge of the sheet is extending a small defined distance downstream from one of the paper path sheet feed roller nips, as shown in FIG. 2, or the fuser rolls nip itself (which, of course is also a paper path sheet feeding nip). That is, measuring sheet lead edge curl when the sheet lead edge is extending from a sheet-holding nip by a known defined and relatively short distance (only a small portion of the sheet dimension). This may be preferable to a curl measurement taken after more of the sheet is extending from a nip, as by then the lead edge of the sheet might be flexing or flapping in between the spaced-apart sheet path defining baffles. However, sensing could be provided for an entire sheet to also check for sheet cockleing, warping or buckling, as can occur in certain print media.

Figure 2:
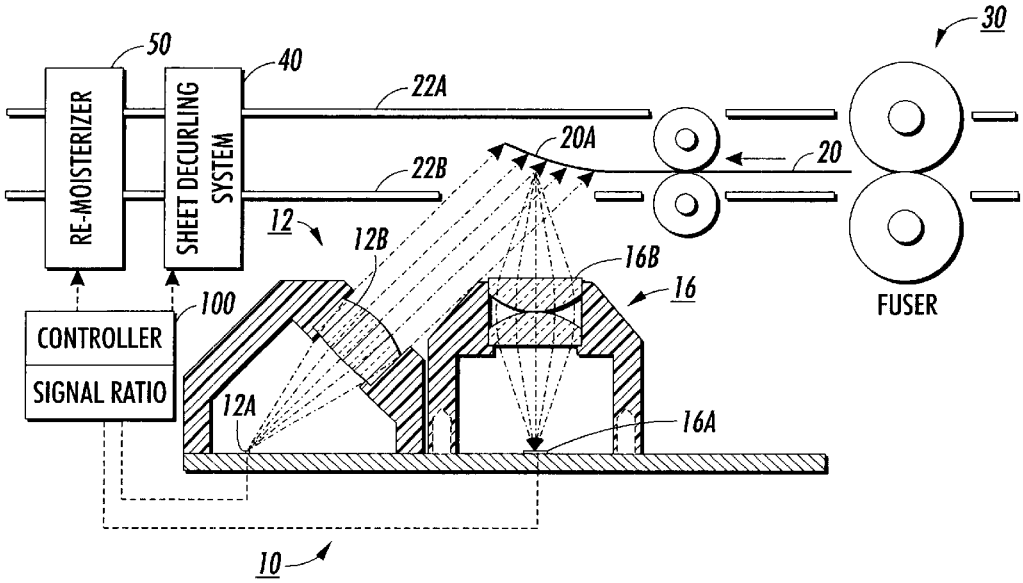
Figure 3:
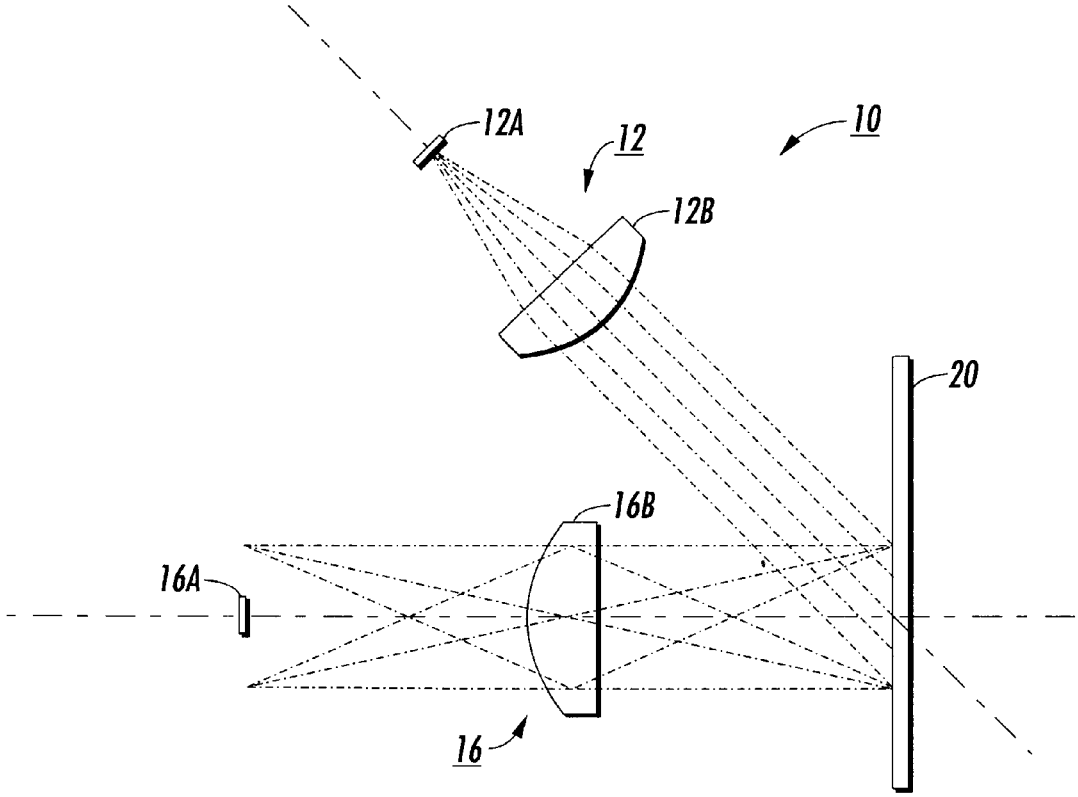
FIG. 3 is a schematic side view of an optical layout of the sheet edge curl sensor of FIGS. 1 and 2.

In FIGS. 1–3, there is illustrated an exemplary embodiment 10 of the subject document edge curl detector system. In this example of FIG. 2 a lead edge curled up area 20A of a sheet 20 is shown moving downstream in a conventional sheet path between conventional spaced apart baffles 22A, 22B, downstream of a conventional fuser 30 receiving sequential said sheets 20 from any conventional upstream xerographic or other printer (not illustrated).

Further illustrated in FIG. 2 are some exemplary, alternative or combined, control applications thereof. That is, FIG. 2 illustrates the application of the output signals of the sheet curl detector 10 to control one or both of a sheet decurling system 40 and a sheet remoisturizer 50 through the existing controller 100 of the reproduction apparatus of this exemplary application. The controller 100 may, as indicated, perform the ratio operation providing the difference in output signal between FIGS. 4 and 5, for example.

The exemplary sheet curl detector 10, as illustrated in FIG. 1, may comprise two orthogonally mounted LED illumination systems 12 and 14, both of which are designed to illuminate the test area of the sheet 20 at an angle of approximately 45°. That reflected light from the sheet 20 is then received by a photodetector system 16 here comprising a photosensor chip 16A and lens 16B.

The two selectively operable light emitter (illumination) units 12 and 14 may be structurally identical other than their orientation at 90° to one another. That is, each of the units 12 may comprise an LED 12A and lens 12B and the unit 14 may comprise a LED 14A and lens 14B. These optics are further illustrated in the FIG. 3 schematic of this optical system. It provides displacement insensitive optics as further described in the above-cited Xerox Corporation U.S. Pat. No. 6,384,918, issued May 7, 2002 to Fred F. Hubble, III, et al.

Figure 4:
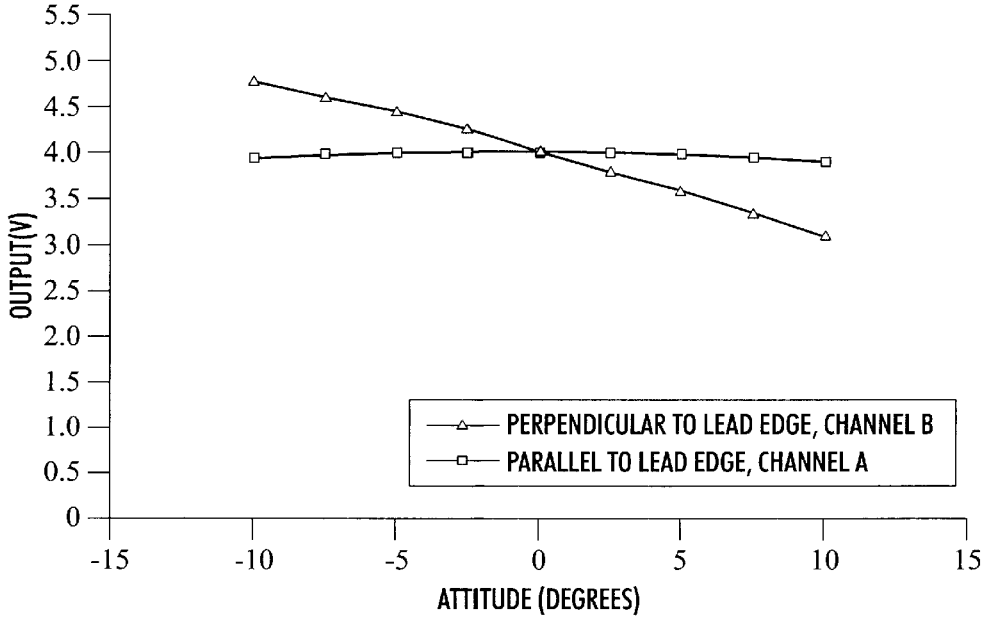
FIG. 4 is an exemplary graph plot for the two different exemplary sensor outputs for the two orthogonal sheet illuminators of FIGS. 1–3, to illustrate a comparison of the signals of those two channels versus the attitude of the paper being sensed.
Figure 5:
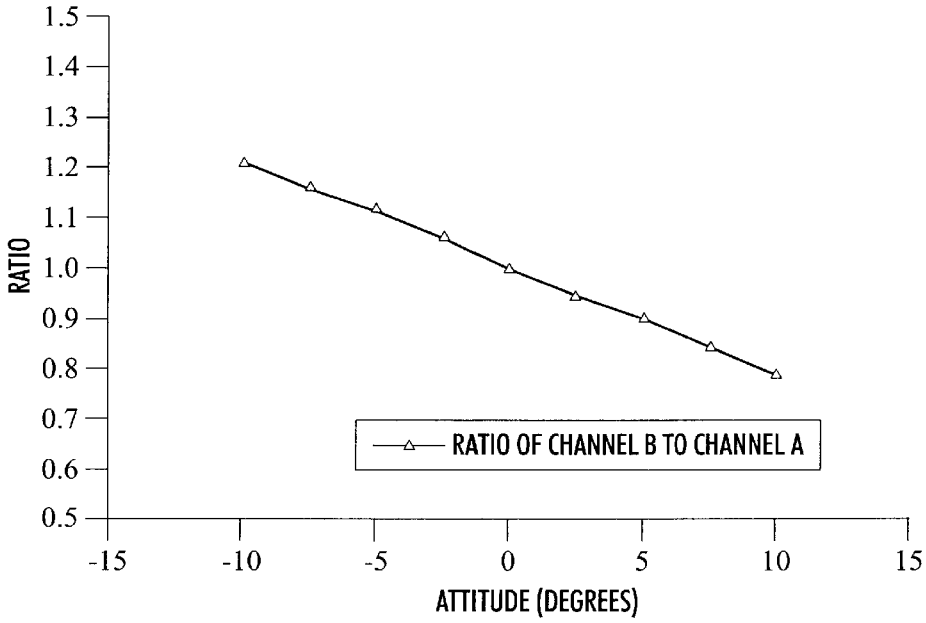
FIG. 5 is similar to FIG. 4, but showing the ratio of those two different sensor output signals as a function of paper attitude.

FIG. 4 refers to the outputs of the photodetector 16A for "channel A" and "channel B." These, it will be appreciated, are the respective outputs of the photosensor 16A to the controller 100 when the lead edge of the sheet is respectively illuminated transversely to or parallel to the lead edge of the sheet. Channel A is the photosensor 16A signal provided by the reflected illumination of the illumination unit 14 of FIG. 1, whereas the channel B signal is the output of the photosensor 16A as receiving light reflected from the sheet 20 when that sheet is being illuminated by the illumination unit 12, which is perpendicular to the lead edge of the sheet 20. As explained, FIG. 5 represents the ratio of these outputs, which is desired as the control signal.

Thus, as noted, in FIG. 2 the sheet curl sensing system 10 is shown positioned below the path of a sheet of paper travelling through a sensing area defined by two light beams and a common detector. Both light beams strike the paper at an angle of 45° to the normal, and detection is performed at 0° to the normal. One of the light beams is aligned substantially parallel to the lead edge of the paper and the other substantially perpendicular, and they are labeled respectively "channel A" and "channel B" in FIGS. 4 and 5. FIG. 2 is a more detailed layout view of the optical system.

The two sensing orientations respond differently to lead edge curl. Channel A aligned parallel to a sheet curl exhibits a lower sensitivity, and Channel B exhibits higher sensitivity, and the ratio of the signals from channel B to those of channel A enables a more accurate measure of curl to be made.

The basis of the differential responsivity may be explained as follows. The amount of light entering the projection (collection) optics is proportional to the irradiance of the paper, the reflectivity of the paper, and the solid angle subtended by the entrance pupil of the lens system.

$$E \propto I \times R \times A \div r^{*}2$$

where:

E=energy entering the projection optic

I=paper irradiance

R=paper reflectivity r=displacement between the paper and the projection lens entrance pupil A=area of the entrance pupil of the lens 16B.

If we design the imaging optics to project a 1:1 image of the paper onto the detector and choose a small detector that will be overfilled by the illuminated image, then the energy striking the detector will be to first order independent of the displacement between the paper and the sensor. This is so because the light energy from the test patch collected by the optics is proportional to the solid angle subtended by the projection lens. As the media to optic displacement, r, varies, the total energy in the image varies by the solid angle, which is proportional to $r^{-2}$. Variation in the media to sensor spacing also affects the image size in a corresponding manner. For 1:1 imaging optics, magnification varies as the inverse of the displacement, $r^{-1}$, which produces a change in the image area proportional to $r^{-2}$. Thus the image energy density, i.e., energy per unit area, becomes invariant to first order with displacement. Since the detector samples a fixed area within the image, its output is thereby made independent of spacing. For constant paper reflectivity, the detector output thus becomes independent of r and depends only on the paper irradiance.

The irradiance pattern on the paper is an elliptical oval defined by the intersection of the incident light beam and the surface of the paper. If the incident beam is circular of radius c, then the nominal irradiance is;

$$I = P \div (\pi \times a \times b)$$

where

P=the optical power in the beam a=major axis of the irradiance pattern b=minor axis of the irradiance beam.

The major axis, a, is given by $$a = c \div \sin(\Theta)$$

here:

θ=the angle between the incident beam and the paper, nominally 45°.

c=the diameter of the incident beam.

Similarly the minor axis is given by $$b = c \div \cos(\Phi)$$

where:

ϕ=the angle between the incident beam and the paper, nominally 0°.

Consider the beam aligned perpendicular to the lead edge of the paper, channel B in FIG. 1. In the absence of rotational disturbances of the paper, such as lead edge curl, the paper irradiance will be $$I_B = (P \times \sin(45) \times \cos(0)) \div (\pi \times c^{*}2)$$

In the presence of lead edge curl the paper irradiance will become $$I_B = (P \times \sin(45 + \Psi) \times \cos(0)) \div (\pi \times c^{*}2)$$

where

ψ=the amount of paper rotation introduced by the curl.

Consider now the beam aligned parallel to the lead edge of the paper. In the absence of rotational disturbances the paper irradiance will be $$I_A = (P \times \sin(45) \times \cos(0)) \div (\pi \times c^{*}2)$$

In the presence of lead edge curl the paper irradiance becomes $$I_A = (P \times \sin(45) \times \cos(0 + \Psi)) \div (\pi \times c^{*}2)$$

Setting $I_A = I_B = 100$ for $\Psi = 0$, the following Table lists the irradiance of the two channels as a function of curl angle along with their ratio $I_B \div I_A$.

| Curl Angle | Relative Irradiance (uW/mm*2) | | Irradiance Ratio, |
|---|---|---|---|
| (degrees) | Channel A | Channel B | ($I_B \div I_A$) |
| −10 | 98.5 | 81.1 | 0.82 |
| −5 | 99.6 | 90.9 | 0.91 |
| 0 | 100.0 | 100.0 | 1.00 |
| +5 | 99.6 | 108.3 | 1.09 |
| +10 | 98.5 | 115.8 | 1.18 |

Thus, by measuring the ratio of channel B to channel A (B/A), the presence of curl and its direction, i.e. curl up or curl down, can be deduced. Sensitivity from these considerations is ~1.8% change in signal per degree of curl.

The technique is insensitive to the reflectivity of the paper because the ratio of the curl sensitive channel (B) to the curl insensitive channel (A) is used as the detection metric. In this scheme the two signals are modulated together by the overall reflectivity of the document.

The technique is also insensitive to localized reflectivity variations which may be caused, for example, by printing. This is so because the part of the illuminated area on the sheet imaged onto the detector is the same for both light beams. In tests, the two channels were easily read in 200 microseconds by pulsing the LED's at 200 mA and using a detector 2.7 mm square. If we consider even a high printing process speed of ~500 mm/second, then the separation between the site measured by channel A and that by channel B will be 0.05 mm, an insignificant amount.

FIGS. 4 and 5 display some early test results. FIG. 4 shows the signals from the two channels as a function of sheet attitude. As expected from the first order considerations described above, channel A varies slowly and channel B varies more quickly as the target rotates away from its nominal, 0° position, and B increases for negative angles and decreases for positive.

FIG. 5 shows the ratio of signal B divided by signal A, and this too behaves as expected, ~2.1% signal change per degree of curl.

What has been disclosed in this example is a non contacting system and method of measuring the lead edge and/or trail edge curl or other non-planer surface irregularity of sheets, especially print media in the paper transport of various reprographic machines. The device is compact and small enough for ease of mounting in various sheet transports, and, as demonstrated above, fast enough to provide measurement data in "real time."

While the embodiment disclosed herein is preferred, it will be appreciated from this teaching that various alternatives, modifications, variations or improvements therein may be made by those skilled in the art, which are intended to be encompassed by the following claims.

What is claimed is:

1. A sheet curl sensing system for sensing the curl of a sheet moving in a movement direction in a sheet transport path, comprising an unobstructing non-contacting optical sheet curl sensor having a first sheet illuminator mounted to illuminate a portion of the moving sheet at an angle in a direction substantially parallel to said movement direction, a second sheet illuminator mounted to illuminate a portion of the moving sheet at an angle in a direction substantially transverse to said movement direction, and a photodetector system positioned to sense the reflected illumination level of said illumination of the moving sheet by both said first and second sheet illuminators as said illumination is reflected approximately perpendicularly from said illuminated portion of the moving sheet and to provide variable output control signals in response to said sensed reflected illumination level.

2. The sheet curl sensing system of claim 1, wherein said variable output control signals in response to said sensed reflected illumination are a ratio of the output control signals from said photodetector system produced by said first and second sheet illuminators.

3. An automatic sheet decurling system comprising a variable sheet decurler and/or re-moisturizer controlled by output control signals from an unobstructing non-contacting optical sheet curl sensor sensing the curl of a sheet moving in a movement direction in a sheet transport path towards said decurler and/or re-moisturizer, said optical sheet curl sensor comprising an unobstructing non-contacting optical sheet curl sensor having a first sheet illuminator mounted to illuminate a portion of the moving sheet at an angle in a direction substantially parallel to said movement direction, a second sheet illuminator mounted to illuminate a portion of the moving sheet at an angle in a direction substantially transverse to said movement direction, and a photodetector system positioned to sense said illumination of the moving sheet by both said first and second sheet illuminators as said illumination is reflected approximately perpendicularly from said illuminated portion of the moving sheet and to provide said output control signals in response to said sensed reflected illumination.

4. The automatic sheet decurling system of claim 3, wherein said variable output control signals in response to said sensed reflected illumination are a ratio of the output control signals produced by said photodetector system from said first and second sheet illuminators.

5. A method of sensing the curl of a sheet moving in a movement direction in a sheet transport path, comprising optically remotely sensing the curl without contacting the sheet with an optical sheet curl sensor having a first sheet illuminator illuminating a portion of the moving sheet at an angle in a direction substantially parallel to said movement direction and a second sheet illuminator illuminating substantially the same portion of the moving sheet at an angle in a direction substantially transverse to said movement direction, and a photodetector sensing the reflected illumination level of said illumination of the moving sheet by both said first and second sheet illuminators as said illumination is reflected approximately perpendicularly from said illuminated portion of the moving sheet and providing variable output control signals in response to said sensed reflected illumination level.

6. The method of sensing the curl of a sheet moving in a movement direction in a sheet transport path of claim 5, wherein said variable output control signals are a function of the ratio of the output control signals produced by said photodetector from said first and second sheet illuminators.

7. An automatic sheet decurling system for sheets in a paper path, comprising a sheet curl measurement system providing an output signal for controlling said sheet decurling system, said sheet curl measurement system optically remotely sensing the curl of a sheet moving in said paper path without contacting said sheet with an optical sensing system operating on a portion of the moving sheet at both an angle thereto and perpendicularly thereto, in both an angular direction substantially parallel to the sheet movement direction and an angular direction substantially transverse to the sheet movement direction, to provide at least two output signals which are ratioed to provide said output signal for said controlling of said sheet decurling system.

8. The automatic sheet decurling system for sheets in a paper path of claim 7, wherein said sheet curl measurement system has sheet displacement insensitive optics.

9. A method of automatic sheet decurling of sheets moving in a sheet path with a sheet decurling system and a sheet curl measurement system providing an output control signal for controlling said sheet decurling system, comprising remotely optically sensing the curl of said sheets moving in a sheet path with said sheet curl measurement system without contacting said sheet by optically operating on a portion of the moving sheet at both an angle thereto and perpendicularly thereto, in both a first angular direction substantially parallel to the sheet movement direction and a second angular direction substantially transverse to the sheet movement direction, to provide separate output signals from said first and second angular directions which are ratioed to provide said output signal for said controlling of said sheet decurling system.

10. The method of automatic sheet decurling of sheets moving in a sheet path of claim 9, wherein said remotely optical sensing includes the use of sheet displacement insensitive optics.

11. The method of automatic sheet decurling of a sheet moving in a sheet path of claim 9, wherein said remotely optical sensing includes a first sheet illuminator sequentially illuminating a portion of the moving sheet at an angle in a direction substantially parallel to said movement direction and a second sheet illuminator alternatively illuminating substantially the same portion of the moving sheet at an angle in a direction substantially transverse to said movement direction, and a photodetector sensing said sequential illumination of the moving sheet by said first and second sheet illuminators approximately perpendicularly from said illuminated portion of the moving sheet.

12. The method of automatic sheet decurling of a sheet moving in a sheet path of claim 11, wherein said remotely optical sensing includes the use of sheet displacement insensitive optics.

* * * * *